US008235016B2

(12) United States Patent
Salameh

(10) Patent No.: US 8,235,016 B2
(45) Date of Patent: Aug. 7, 2012

(54) HOUSING PART HAVING SEALING FACE AND SEAL FOR INTERNAL COMBUSTION ENGINE

(75) Inventor: Ralf Salameh, Gondelsheim (DE)

(73) Assignee: Federal-Mogul Sealing Systems Bretten GmbH, Bretten (DE)

( * ) Notice: Subject to any disclaimer, the term of this patent is extended or adjusted under 35 U.S.C. 154(b) by 482 days.

(21) Appl. No.: 12/279,801

(22) PCT Filed: Jan. 18, 2007

(86) PCT No.: PCT/EP2007/000435

§ 371 (c)(1),
(2), (4) Date: Dec. 1, 2008

(87) PCT Pub. No.: WO2007/093265

PCT Pub. Date: Aug. 23, 2007

(65) Prior Publication Data

US 2009/0217900 A1 Sep. 3, 2009

(30) Foreign Application Priority Data

Feb. 16, 2006 (DE) ..... 10 2006 007 312

(51) Int. Cl.
*F01M 9/10* (2006.01)

(52) U.S. Cl. ..... 123/90.38

(58) Field of Classification Search ..... 123/195 C, 123/198 E, 90.37, 90.38

See application file for complete search history.

(56) References Cited

U.S. PATENT DOCUMENTS 6,591,801 B1 * 7/2003 Fonville ..... 123/90.38

FOREIGN PATENT DOCUMENTS

| | | | |
|---|---|---|---|
| JP | 63088375 | A | 4/1988 |
| JP | 04255555 | A | 9/1992 |
| JP | 2001124207 | A | 5/2001 |

* cited by examiner

*Primary Examiner* — Zelalem Eshete

(74) *Attorney, Agent, or Firm* — Roberts L. Stearns; Dickinson Wright, PLLC

(57) ABSTRACT

A housing part has a sealing surface around the housing part which is to be fastened by means of a seal to another housing part in a sealing manner. At least one fastening opening is provided for the guiding through of fastening elements, in order to seal the housing part on another housing part. At the at least one fastening opening, a ring-shaped projection is arranged which projects over the sealing surface and defines a minimum distance between the sealing surface of the housing part and sealing surface on the other housing part.

5 Claims, 3 Drawing Sheets

HOUSING PART HAVING SEALING FACE AND SEAL FOR INTERNAL COMBUSTION ENGINE

BACKGROUND OF THE INVENTION

1. Technical Field

The present invention relates to housing parts with sealing surfaces, such as covers or caps, which are fastened with a seal and fastening elements which engage through corresponding fastening openings on the housing parts or on other machine parts, in particular for internal combustion engines. In particular, the present invention concerns housing parts in which sleeves are provided in the fastening openings, which sleeves project in the direction of the sealing surface and which serve as pressure limiters for a seal. The present invention likewise concerns a seal for such a housing part.

Seals with plastic supporting frames which are provided with metallic inserts are already known. These inlets are usually metal elements such as, for example, metal discs, U-tongues or flanges, which are integrated in the region of the screw and serve there as pressure limiters, because the greatest forces are introduced at the screwing points. These pressure limiters are intended to prevent for example an elastomer seal from being compressed too strongly in the region of the fastening screws and hence losing its sealing effect. Seals are likewise known in which metal elements are used as path limiters or pressure limiters at other locations than the fastening passages. The forces of the fastening screws are only partially transferred here via the seal.

All the known solutions aim for a certain functional separation, in which other elements can support or receive a portion of the screwing forces, because the plastic support of the seal is not able to do this over a lengthy period of time, because its plastic can withdraw from a load by creeping away. The known plastic support therefore substantially has the function of supporting the seal, whilst metal elements which are integrated in the plastic support receive the screwing forces. It is likewise possible that a metallic supporting frame undertakes both functions.

Seals with metallic supporting frames of, for example, steel or aluminium, are becoming increasingly more expensive due, inter alia, to rising metal prices. Their replacement by plastic supporting frames can offer cost advantages particularly in the case of high production quantities. The present invention substantially concerns seals which consist of a punched-out supporting frame on which a seal body of elastomer material is vulcanized, and housing parts which can be connected with such seals.

2. Related Art

The fundamental aim is therefore to substitute the supporting frame of aluminium or steel by plastic. The problem exists here that plastic supporting frames, compared with metal supporting frames under operating conditions (screwing forces, temperature, time) do not have a sufficient strength and therefore the screwing security is no longer guaranteed. One method which is already applied in seals with plastic supporting frames consists in integrating metallic elements into the supporting frame. These largely receive the screwing forces and prevent a "creeping away" of the plastic under stress (pressure, temperature, . . . ). As these additional elements also, in turn, entail costs, a solution is to be found in which the integration of inserts can be dispensed with.

In addition, it is to be possible to also make such a seal resistant to temperature, oil, vibration and corrosion, in order to also be able to be used in machine covers such as, for example, cylinder head covers and oil sumps of plastic.

SUMMARY OF THE INVENTION AND ADVANTAGES

According to a first aspect of the present invention, a housing part is provided with at least one sealing surface and at least one fastening opening. The at least one sealing surface serves to be able to fasten the housing part in a sealing manner by means of a seal on another housing part, in which for example an elastomer seal is to be arranged between the respective sealing surfaces of the housing part and those of a corresponding complementary other machine part or housing part, for example an elastomer seal. The at least one fastening opening for the passage of at least one fastening element (such as, for example, a screw, a rivet, an expanding rivet, or an (adhesion) nail) serves here as a bearing and guide for the fastening elements, in order to fasten the housing part (and the seal) on another housing part or machine part in a sealing manner.

In the housing part according to the invention, a ring-shaped projection is arranged at (at least) one fastening opening, which projection projects over the sealing surface. Through this projection, a minimum distance is defined between the sealing surface of the housing part and a sealing surface on the other housing part. This projection therefore serves for a mounted seal as a pressure limiter.

The ring-shaped projection can also serve to fasten a correspondingly shaped seal on the projections by form or friction fit.

The housing part can, for example, be a machine cover such as a cylinder head cover or an oil sump.

The ring-shaped projection is preferably cast directly around the fastening opening on the housing part. In the case of metallic covers, a further cost reduction can be achieved with this solution when the ring-shaped projections are also cast on directly for example around the screw-on openings (i.e. fastening openings).

Advantageously, the ring-shaped projection is formed by a sleeve arranged in the fastening opening, which sleeve projects over the sealing surface.

The solution to the problem takes place in that also in the invention a separation of the functions is achieved. The receiving of the forces is not realized via metallic elements which are integrated into the plastic supporting frame or via flange support. The screwing forces are transferred via conventional metal sleeves in the plastic caps which in accordance with the invention (at corresponding recesses) submerge through the plastic seal and thus ensure a metallic contact of screw, sleeve and flange. Here, the sleeve serves for a mounted seal as pressure limiter.

The sleeve is preferably substantially cylindrical, i.e. tubular. Preferably, the sleeve is provided on the outer covering surface with a milling. Through the milling, the sleeve can substantially be pressed into the housing part. Through the milling, a particularly good form fit can be achieved between the sleeve and the housing part, when the sleeve is formed (e.g. injected) directly into the housing part.

Through the milling, a seal with correspondingly formed fastening passages (e.g. screw holes) can press the seal via passages onto the milled sleeve or the milling on the sleeve, and thus fasten the seal by friction/form fit on the housing part.

The sleeve is preferably provided with a retainer in order to keep a fastening element in the sleeve so that it is secure against loss. The metal sleeves can be combined with retained screws so that a composite is produced which is ready for construction. The retainer can also be formed for example by an inserted plastic ring or by a punching in (which is more favourably priced).

The projection or the sleeve preferably has an (outer or inner) flange on the side of the sealing surface of the housing part. This flange or collar increases the bearing surface of the sleeve on the other, opposite, housing part.

Advantageously, in the region of the (outer) flange, the housing part has at least one recess which extends adjacent to and behind the flange. Through this recess, it can be ensured that sufficient space is available so that corresponding hooks, catches or snap tongues of a correspondingly equipped seal can engage behind the flange, in order to fasten the seal to the housing part.

In a preferred solution, the seal with the plastic support can therefore be connected with the flange so as to be secure against being lost. This can be realized by various solutions for which the projecting metal sleeves are also used. The metal sleeves can have a collar and the plastic support of a seal can be provided with corresponding elements by which the seal can be fixed to the collar or to the flange. These elements make possible a simple engagement and a very good security against loss of the seal with respect to the housing part.

In a particularly preferred embodiment, the flange or the collar is provided with a chamfer in order to simplify the engagement or the fastening of a seal. The chamfer in fact reduces the bearing surface, but can substantially simplify the fastening of a seal.

The sleeve is preferably provided with a flange on the side facing away from the sealing surface of the housing part. This flange can, for example, be produced by flanging. The flange can fasten the sleeve for example as a hollow rivet on the housing part.

The sleeve is preferably provided with a step on which the housing part can rest on the sleeve. Through the step, it can be ensured that a pressure which presses onto the housing part by a connecting element such as a screw, can not press the housing part downwards via the sleeve (if, for example, a washer introduces the force of a screw only into the housing part). A further advantage results from a shorter sleeve being able to be used.

Advantageously, the sleeve is widened in a tapered manner on the side facing the sealing surface. Thereby, the sleeve can for example be jammed in the lower widened region in the fastening opening of the housing part and therefore can no longer fall out from the fastening opening. The sleeve can be widened for example by a tapered pin. Through the widening, a seal with correspondingly shaped openings can be securely riveted to the sleeves acting as a hollow rivet. Here, the enlargement of the diameter of the sleeve acts on the frame of the seal like a blind riveting.

The housing part is preferably made of plastic, and the sleeve consists at least partially of metal.

According to another aspect of the present invention, a seal is provided with a sealing region and passages for fastening elements. The sealing region can be made, for example, from elastomer and can have sealing lips. According to the invention, the seal and the passages for fastening elements are provided with holding elements which can engage behind corresponding flanges of a housing part, which are arranged on projections or on sleeves, which in turn are arranged in fastening holes. Through the holding elements, the seal can be fastened on the housing part.

The seal is preferably an elastomer seal, in which the holding elements are constructed as holding lips running around the passages, which can respectively place themselves behind a flange of a pressure limiter sleeve or of a corresponding projection. The embodiment is particularly suited to full elastomer seals. Another advantage consists in that the seal can use a rigid frame, in which the flexible holding elements can be simply also injected on from the seal material, which reduces the manufacturing costs.

The seal preferably has a sealing region of elastomer, for example with sealing lips of elastomer.

In an advantageous embodiment, the seal has a frame of plastic or metal.

The holding elements of the seal are preferably made of plastic or metal. The holding elements can be constructed as snap tongues, catches or hooks.

According to a further aspect of the present invention, a seal is provided with a sealing region and passages for the fastening elements, in which the passages are adapted to ring-shaped projections of a housing part which is to be sealed, in order to be able to wedge itself securely on the housing part.

It is possible that diameters of the passages are adapted to corresponding external diameters of corresponding ring-shaped projections on the housing part, in order to be able to wedge securely through the seal on the projections by a friction fit. Provision is likewise made to construct the passages so as to be conical, if the projections can be bent outwards in the manner of a hollow rivet, in order to be able to fasten the seal on a housing part.

The seal preferably has wedging segments on the passages, with which the seal can wedge itself on projections of a correspondingly formed housing part.

THE DRAWINGS

Preferred embodiments of the present invention are illustrated in the figures.

DETAILED DESCRIPTION

Figure 1:
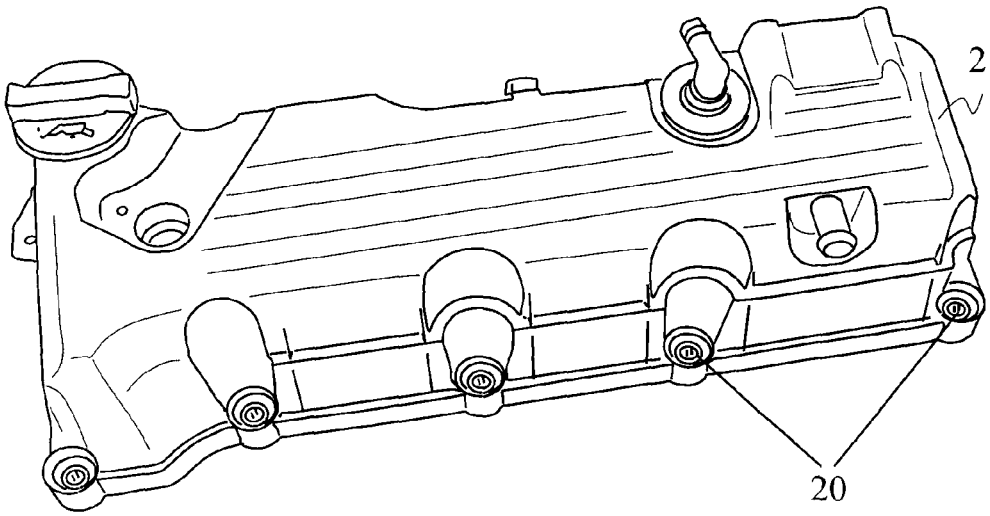
FIG. 1 shows an oblique view of a housing part constructed as a cylinder head cover.

Both in the figures and also in the drawings the same reference numbers are used to illustrate identical or similar elements and assemblies. The illustrations may be partially diagrammatic or not to the correct scale.

FIG. 1 shows an oblique view of a housing part 2 constructed as a cylinder head cover (valve cover) with (metal) sleeves 20 inserted in the fastening holes.

Figure 2:
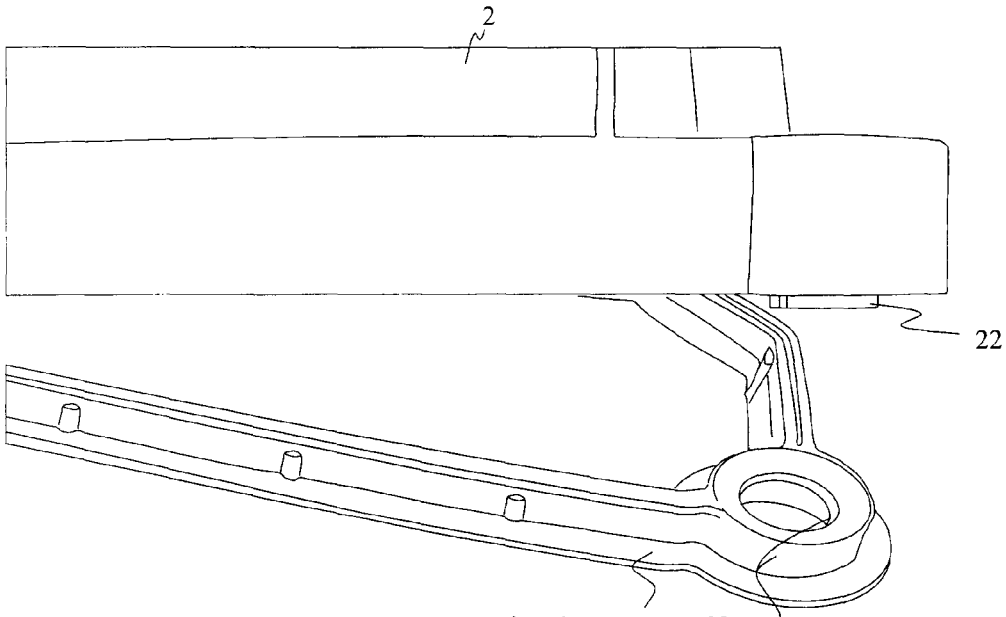
FIG. 2 illustrates a detail view of the cylinder head cover of FIG. 2 with an elastomer seal.

FIG. 2 illustrates a detail view of the cylinder head cover 2 of FIG. 2 with an elastomer seal 80. On the corner, it can be seen how a metal sleeve 20 forms a projection 22 which serves as a pressure limiter for the elastomer seal 80. At the site of the metal sleeve 20, the elastomer seal 80 is provided with a holding lip 82 which can lay itself around the sleeve 20 in order to fasten the elastomer seal 80 on the cylinder head cover 2. FIG. 2 illustrates an elastomer seal 80 without a supporting frame (in which also the cylinder head cover is designed to receive this seal 80).

Figure 3A:
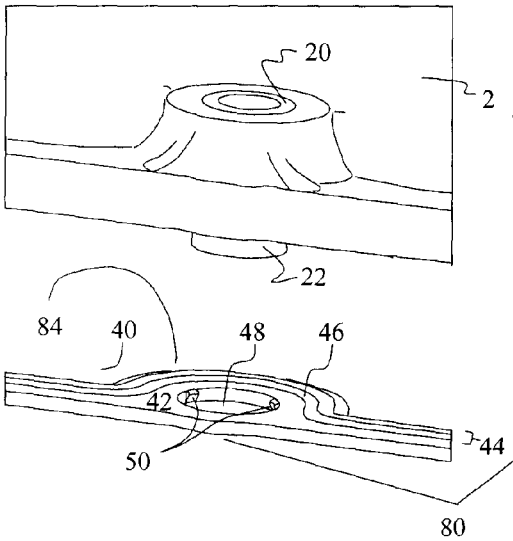
FIGS. 3A and 3B illustrate respectively detail views of a cylinder head cover with a seal with plastic supporting frame.
Figure 3B:
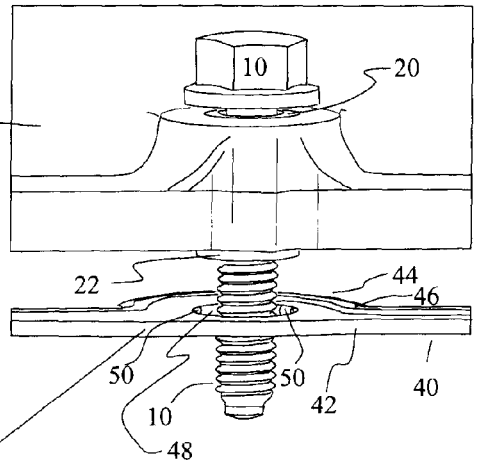

FIGS. 3A and 3B illustrate respectively detail views of a cylinder head cover 2 with a plastic supporting frame seal 40. The seal 40 has a plastic supporting frame 42, a sealing region 44 with sealing lips 46 and a fastening hole 48. A metal sleeve 20 forms a projection 22 which serves as a pressure limiter for the plastic supporting frame seal 40. In FIG. 3B in addition a fastening element 10 is illustrated, which is constructed as a screw.

Figure 4A:
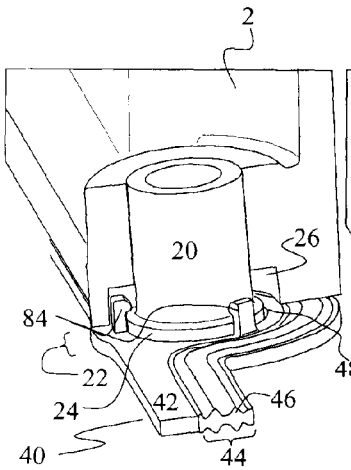
FIGS. 4A and 4C illustrate respectively detail sectional views of a cylinder head cover with a metal sleeve with a flange.
Figure 4B:
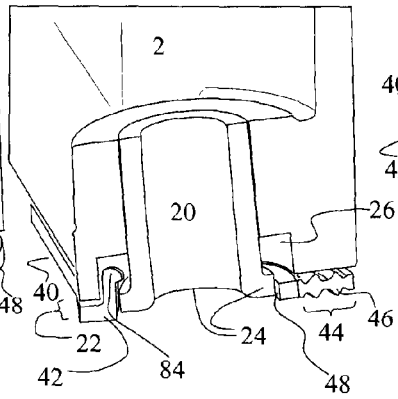
Figure 4C:
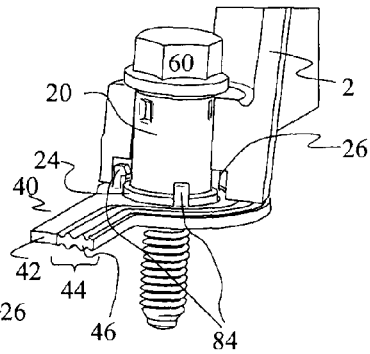

FIGS. 4A to 4C illustrate respectively detail sectional views of a cylinder head cover 2 with a metal sleeve 20, which is provided with a flange or collar 24. Recesses 26, which extend adjacent to and behind or over the flange 24, allow holding elements 84 (such as hooks, claws, catches or snap tongues) of the plastic supporting frame seal 40 to engage behind the flange and fasten the plastic supporting frame seal 40 via the metal sleeve(s) 20 to the cylinder head cover 2.

Like the seal of FIG. 3, the seal 40 has a plastic supporting frame 42, a sealing region 44 with sealing lips 46 and a fastening hole 48. The holding elements or detent segments 84 are arranged here around the fastening hole 48 of the plastic supporting frame seal 40. In FIG. 4 C, the metal sleeve 20 is illustrated with flange 24 of a screw 10. The screw 10 is secured by the retainer 12, formed as impressions, in the metal sleeve 20, so that the screw 10 can not fall out from the metal sleeve 20 or the cylinder head cover 2.

In the illustrated embodiment, the metal sleeves 20 are provided with a flange or collar 24, and the plastic supports have corresponding elements by which the seal can be fixed on the collar. This combination makes possible a simple engagement and a very good securing against unintentional loss of the seal. Such a connection can take place at one or more screwing points, depending on the size of the seal.

A corresponding variant occurs when the metal sleeve has a groove into which plastic noses engage. Such an embodiment can, however, also be considered as a combination of a flange with a stepped metal sleeve.

Figure 5A:
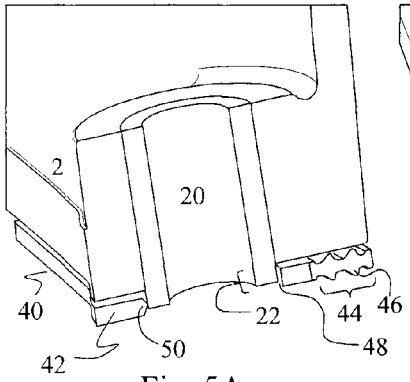
FIGS. 5A to 5C illustrate respectively detail sectional views of a cylinder head cover with a metal sleeve and a seal with wedging segments.
Figure 5B:
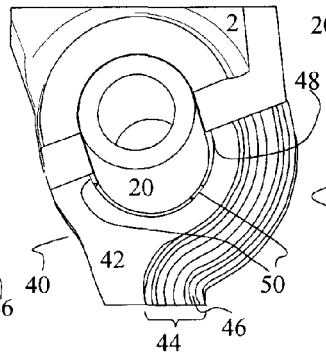
Figure 5C:
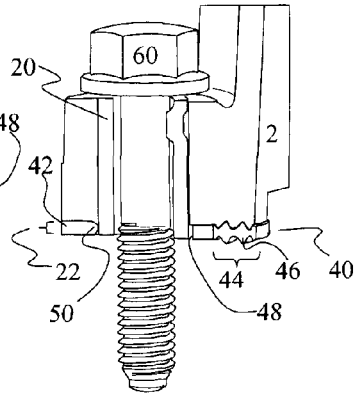

FIGS. 5A to 5C illustrate respectively detail sectional views of a cylinder head cover 2 with a straight metal sleeve 20 and a plastic supporting frame seal 40 with wedging segments 50. In this embodiment, the metal sleeves 20 are constructed so as to be straight. The wedging segments 50 of the plastic supporting frame seal 40 can best be seen in FIG. 5B. In FIG. 5C, the screw 10 is secured by the retainer 12, formed as impressions, in the metal sleeve 20, so that the screw 10 can not fall out from the metal sleeve 20 or the cylinder had cover 2. In the illustrated variant, the seal 40 is wedged by means of a friction fit on two or more metal sleeves 20.

Figure 6A:
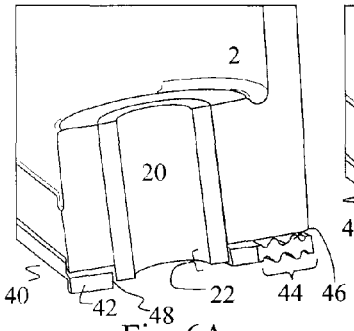
FIGS. 6A to 6C illustrate respectively detail sectional views of a cylinder head cover with a conically widened metal sleeve.
Figure 6B:
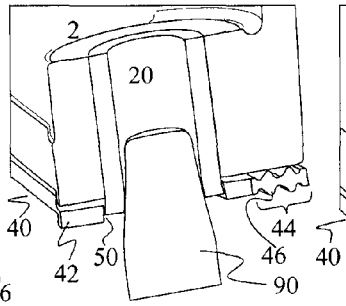
Figure 6C:
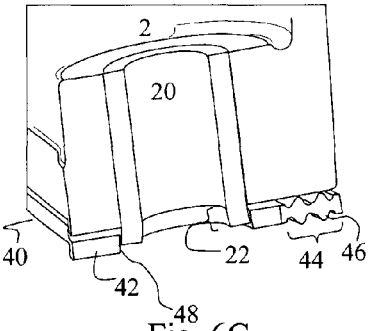

FIGS. 6A to 6C illustrate respectively detail sectional views of a cylinder head cover 2 with a conically widened metal sleeve 20. Together, FIGS. 6A to 6C illustrate the secure riveting of the plastic supporting frame 42 to the plastic supporting frame seal 40. The metal sleeve 20 is widened conically here in the lower region by a tapered pin 90, whereby the supporting frame 42 of the seal 40 is riveted to the cylinder head cover 2. The metal sleeve acts here as an expanding hollow rivet. (The metal sleeve 10 can likewise be provided with a retainer). In this figure, the seal is wedged onto the housing part 2 by means of a widening of two or more metal sleeves 20.

The bores or fastening holes or fastening openings 48 can be conical in construction to achieve a better connection. The bores or fastening holes or fastening openings 48 in the plastic supporting frame can be, for example, 0.5 mm greater than the external diameter of the metal sleeve 20 in the region of the projection 22. The tapered pin widens at least two metal sleeves, in order to fix the seal on the component or housing part 2.

Figure 7A:
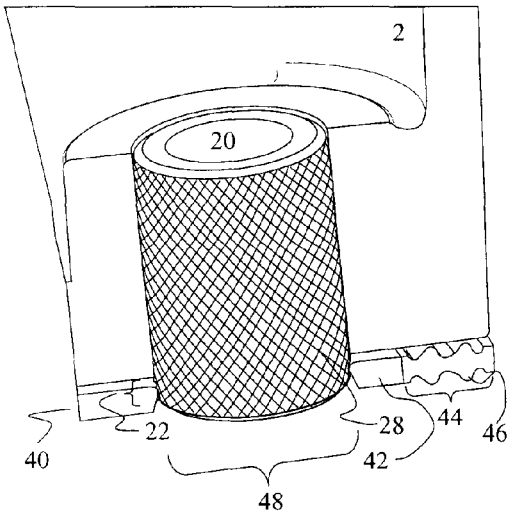
FIGS. 7A and 7B illustrate respectively detail sectional views of a cylinder head cover with a straight milled metal sleeve.
Figure 7B:
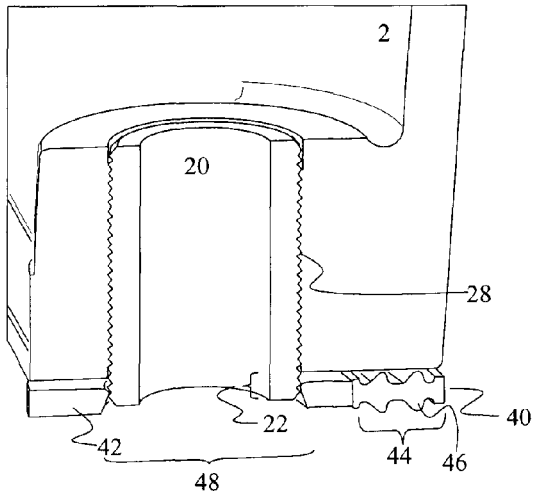

FIGS. 7A and 7B illustrate respectively detail sectional views of a cylinder head cover 2 with a straight, milled metal sleeve 20. The milling 28 can secure the milled sleeve 20 better in the cylinder head cover 2. The milling 28 can, in addition, increase the friction between a supporting frame 42 and the metal sleeve 20, whereby the seal 40 can be fastened by a friction fit on the cylinder head cover 2. The milled metal sleeve 20 can likewise be provided with a retainer. It is likewise possible for example to use the seal of FIG. 5 together with milled metal sleeves. Likewise, it is possible for example to use the riveting method of FIG. 6 with milled metal sleeves 20. In addition, the metal sleeves 20 which are provided with a milling 20 can likewise be provided with a retainer 12.

The bores or fastening holes or fastening opening 48 in the plastic supporting frame can be constructed for example 0.1 mm smaller than the external diameter of the milled metal sleeves 20.

The metal sleeves 20 of the plastic cap 2 have a projection 22 in the direction of the flange surface, which projection is dimensioned to be as great as the required sealing gap. The bore diameters in the supporting frame of the seal are dimensioned so that the metal sleeve 20 passes therethrough. The seal can also be coupled with the cap 2 via these sleeves 20, so that the system can be delivered together. Other fastenings of seal to cover are also conceivable. In FIGS. 7A and 7B, the seal 40 is pressed via a milled bush sleeve 20/milling 28 on the bush/sleeve 20.

The metal sleeves can be combined with retained screws, so that a composite is produced which is ready to be constructed. In a preferred solution, the seal with plastic support can be connected with the flange in a retained manner. This can be realized by means of various solutions for which the projecting metal sleeves are also used.

The identical solution can be applied in metallic covers. However, a further cost reduction can be achieved here when the ring-shaped projections are also cast on directly around the screw-on openings.

The following advantages can be achieved by the sealing system according to the invention:

- The (plastic) supporting frame of a (plastic) supporting frame seal can be constructed without additional metallic support elements,
- It is possible to pre-assemble the system or module,
- Retained connections of cover and seal possible, preferably in combination seal with plastic supporting frame,
- Plastics such as preferably polyamide types such as for example polyamide 6.6 can be used,
- duroplastic plastics can also be used, and
- the invention can also be used in combination with metallic housing parts such as caps such as for example aluminium caps.

The invention claimed is:

1. A housing part, comprising:

a sealing surface of the housing part;

a compressible seal engagable with the sealing surface;

at least one opening through the sealing surface for accommodating a fastener in order to fasten the housing part of an accompanying part and to establish a fluid-tight seal therebetween; and a ring-shaped projection extending from the sealing surface for engaging the accompanying part to establish a minimum distance therebetween to limit the amount of comparison of the seal wherein the ring-shaped projection is formed by a sleeve arranged in the fastening opening, which sleeve projects over the sealing surface; the sleeve is provided with a radially extending flange on the side of the sealing surface of the housing part; and the housing part is provided in the region of the radially extending flange with at least one recess which extends adjacent to and behind the flange.

2. The housing part according to claim 1, wherein the sleeve is provided with a flange on the side facing away from the side of the sealing surface of the housing part.

3. The housing part according to claim 1, wherein the sleeve is provided with a step on which the housing part can rest on the sleeve.

4. The housing part according to claim 1, wherein the sleeve is widened in a tapered manner on the side facing the sealing surface and wedges itself in the widened region in the fastening opening of the housing part.

5. The housing part according to claim 1, wherein the housing part is made from plastic and the sleeve consists at least partially of metal.

* * * * *